United States Patent [19]

Magid

[11] 4,176,420

[45] Dec. 4, 1979

[54] SURFACE TREATING PAD

[75] Inventor: David J. Magid, Doylestown, Pa.

[73] Assignee: Cello Chemical Company, Warrington, Pa.

[21] Appl. No.: 921,526

[22] Filed: Jul. 3, 1978

[51] Int. Cl.[2] ..... A47L 13/07; B21F 45/00

[52] U.S. Cl. ..... 15/230; 15/209 C; 29/4.5 B; 140/71 C

[58] Field of Search ..... 15/209 B, 209 C, 209 D, 15/230, 230.16, 230.17, 230.19; 29/4.5 B; 51/400, 401, 403, 404; 140/71 C; 428/605, 932; 242/2

[56] References Cited

U.S. PATENT DOCUMENTS

| | | | |
|---|---|---|---|
| 1,606,884 | 11/1926 | Mann et al. | 140/71 C X |
| 1,646,396 | 10/1927 | Field | 428/605 X |
| 1,995,808 | 3/1935 | Homon | 140/71 C |
| 2,242,326 | 5/1941 | Rosenthal | 140/71 |
| 2,257,456 | 9/1941 | Crockford | 15/209 D |
| 2,265,370 | 12/1941 | Hennessy | 140/71 C |
| 2,941,225 | 6/1960 | Paul | 15/209 D |
| 3,039,125 | 6/1962 | Benjamin | 15/209 C X |

FOREIGN PATENT DOCUMENTS

| | | | |
|---|---|---|---|
| 176587 | 7/1935 | Switzerland | 15/209 C |
| 143680 | 3/1919 | United Kingdom | 15/209 D |
| 348922 | 5/1931 | United Kingdom | 15/209 B |

*Primary Examiner*—Daniel Blum

*Attorney, Agent, or Firm*—Edwin E. Greigg

[57] ABSTRACT

A pad for treating surfaces such as floors or the like which includes a plate member of rigid material which is wrapped with a continuous ribbon of stainless steel which is relatively thin and narrow, the wraps extending in a circular manner successively over and under the plate member, successively and alternately, in random directions to build up a soft, cushiony mass of the stainless steel strip to a thickness such that the wound ribbon completely covers the plate member in a plurality of layers with the plate member disposed centrally within the mass to form a pad suitable for attachment to a floor-treating machine.

This invention relates to an apparatus for treating surfaces and more particularly to a pad of stainless steel arranged to be mounted on a machine for treating surfaces such as floors.

1 Claim, 7 Drawing Figures

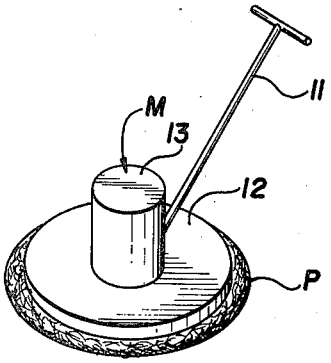
FIG. 1
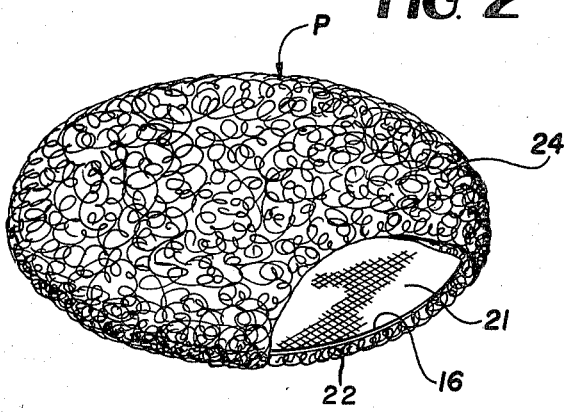
FIG. 2
FIG. 3
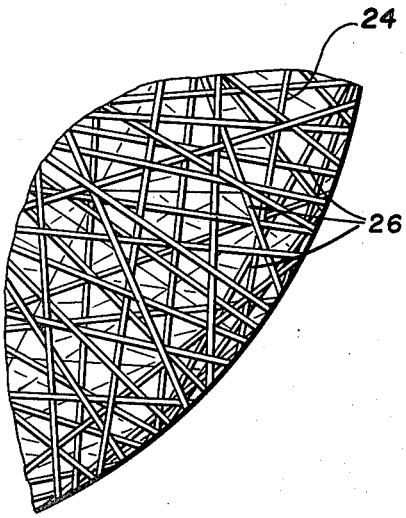
FIG. 5
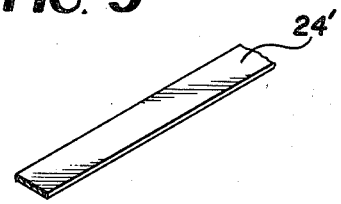
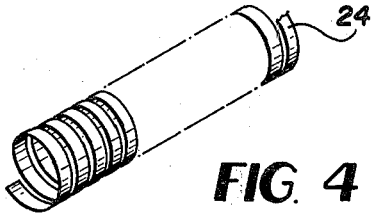
FIG. 4
FIG. 6
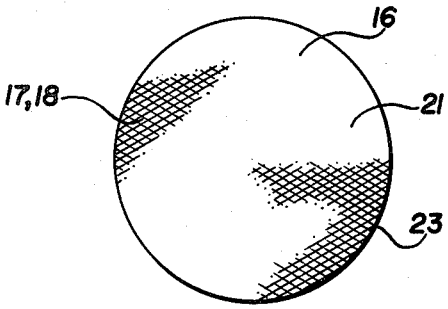
FIG. 7
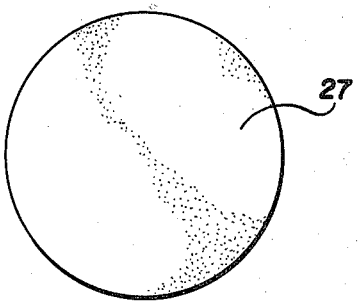

SURFACE TREATING PAD

BACKGROUND OF THE INVENTION

Surfaces such as floors in structures such as office buildings, residences and the like generally require the application of a coating of wax for preservation, appearance, etc., and the application of wax to floors of wood, asphalt, vinyl asbestos, vinyl tile, marble, and terrazzo is a wide-spread practice. Usually such floors, particularly floors of relatively large area, require the utilization of a motor-driven, hand-guided machine provided with a pad of suitable material for varied uses such as the application of wax, buffing, scouring, and the like. When the wax to be applied to the floor is in paste form, such present-day machines utilize a steel wool pad which is formed by sewing steel wool together to form a pad or by rolling steel wool into a circular shape at the job site to form the pad. The use of such a steel wool pad is characterized by a number of disadvantages. For instance, such a steel wool pad frays very quickly and rusts, so that its useful life is extremely short. Furthermore, such a steel wool pad throws steel wool lint over the floor being treated, which must ultimately be removed and can even interfere with the surfacing operation. Furthermore, the use of such steel wool often causes the floor to carbon-burn or blacken.

Another technique for treating floors involves a method known as spray buffing, commonly employed to maintain a floor that has previously received an application of a liquid wax or finish. Such a spray buffing operation generally utilizes a nylon pad which is attached to a floor machine, the nylon pad containing a gritty substance on the surface for abrasion. A spray buff solution is then prepared using part floor finish or wax and water. The operator operates the machine with the pad attached while spraying a fine mist on the floor. Such a spray buffing operation is utilized to remove scuff and black heel marks and to reshine the floor. The use of a nylon pad for such a spray buffing operation has many drawbacks. The nylon pad cannot be washed out easily, and the abrasive material of the pad is quickly exhausted, requiring frequent replacement of the pads. Furthermore, when using high-speed machines for such a spray buffing operation which rotate up to 250 rpm or higher, the surface of the pad tends to become clogged with floor finish or wax, and because of the heat generated will drag and stick to the floor, causing the machine to heat up and blow circuit breakers to interrupt the operation.

A nylon pad is also used with such floor machines for another operation, which involves the stripping off of wax or finish from a floor. This stripping operation is accomplished by applying hot soap and water to the floor and then abrading the floor finish or wax off the floor, utilizing the nylon pad attached to the floor machine. Again, the use of such a nylon pad for a stripping operation is characterized by a rapid wearing out of the abrasive material, requiring frequent pad replacement. In addition, many commercially available nylon pads are not cut accurately, which often causes the high-speed floor machine to wobble with attendant operator fatigue.

OBJECTS, SUMMARY AND ADVANTAGES OF THE INVENTION

A primary object of this invention is to provide a new and novel stainless steel pad for use with floor machines which permits the performance of a multitude of floor treating operations in a highly efficient manner.

Another object of this invention is to provide a new and novel stainless steel pad for use with a floor treating machine which permits the application of paste wax to floors of any material, which will not throw out lint and which buffs wax into the floor to provide a very hard finish characterized by better appearance and more resistance to scuffing.

Still another object of this invention is to provide a new and novel pad for use with a floor treating machine which will not rust and which can be washed or steamed out for reuse repeatedly.

Still another object of this invention is to provide a new and novel stainless steel pad for floor treating machines which may be used for spray buffing waxed floors, which continually cuts excess wax off the floor to eliminate tacking to the floor and which is not only low in initial cost but produces a savings by lasting 2 to 3 times longer than nylon pads.

A still further object of this invention is to provide a new and novel stainless steel pad for floor treating machines which may be used in a wax stripping operation with longer-lasting cutting surfaces so as to require the use of fewer pads, is capable of repeated use after a simple washing operation and which has a sponge-like effect so that the pad seats evenly under the floor machine, allowing the floor machine to run smoothly and eliminate operator fatigue.

Still another object of this invention is to provide a new and novel stainless steel pad for use with a floor treating machine which will not carbon-burn or blacken floors.

The objects of this invention and other related objects are accomplished by the provision of a pad which includes a substantially planar, disc-shaped core member of rigid material such as wire mesh or plastic having a top surface and a bottom surface. A continuous narrow strip of stainless steel, which may be flat or of helical configuration, is wound successively and alternately over the top and bottom surfaces of the core member in random directions relative to these surfaces in a plurality of wraps which extend around the marginal edge of the core member to form a sponge-like mass with the core member disposed centrally within the mass. In accordance with the type of operation for which the pad is to be used, the width of the stainless steel strip may be varied, preferably within the range of 1/16 to ⅛ of an inch and the thickness of the strip may be varied in accordance with the desired tensile strength required. The strip may also be in the shape of a flat ribbon, may be curled throughout its length in a series of coils, or may even be coiled partially in accordance with the end use of the pad.

The invention will be better understood as well as further objects and advantages thereof become more apparent from the ensuing detailed description of preferred embodiments taken in conjunction with the drawings.

BRIEF DESCRIPTION OF THE DRAWINGS

FIG. 1 is a perspective view of a conventional floor treating machine with which the pad of the invention is utilized;

FIG. 2 is a perspective view partially broken away of the pad of the invention;

FIG. 3 is an enlarged view of a portion of the pad of FIG. 2;

FIG. 4 is a perspective view of one form of the stainless steel strip utilized in the construction of the pad of FIG. 2;

FIG. 5 is a view of another form of the stainless steel strip utilized in the pad of FIG. 2;

FIG. 6 is a plan view of one embodiment of the core member utilized in the pad of FIG. 2; and FIG. 7 is a plan view of another embodiment of the core member utilized in the pad of FIG. 2.

DESCRIPTION OF THE PREFERRED EMBODIMENTS

Referring now to the drawings and to FIG. 1 in particular, there is shown a floor treating machine of conventional type which is designated generally by the letter M. The floor machine M is used in the conventional manner for such operations as the application of wax to surfaces such as floors or the like, buffing such floors or stripping wax from a surface. The floor machine M is provided with a swinging handle 11 for manipulation of the machine by the operator and also includes a housing 12 which supports an electric motor 13 by means of which a pad constructed in accordance with the invention and designated generally by the letter P is rotatably driven.

As is well known, the pad P is attached to the undersurface of the machine housing 12 for engagement with the surface or floor to be treated.

As specifically illustrative of the invention, the pad P of the invention as shown best in FIG. 2 includes a substantially planar, disc-shaped core member of rigid material which in the embodiment of FIG. 6 comprises a plate 16 of wire mesh formed with intersecting stainless steel wires 17, 18 suitably secured together by welding or the like somewhat in the form of a screen. In the preferred embodiment, the pad P is of circular shape and therefore the core member or disc 16 is similarly of circular shape as shown.

The disc 16 is therefore provided with a top surface 21, a bottom surface 22 and a peripheral edge 23.

In one embodiment of the pad P of the invention, a continuous narrow strip of ribbon 24 of stainless steel is utilized which is wound successively and alternately over the top and bottom surfaces 21, 22 of the core member or disc 16 in random directions relative to the surfaces 21, 22 in a plurality of wraps 26 as shown best in FIG. 3 around the marginal or peripheral edge 23 of the disc 16. In the embodiment of FIG. 4 and as shown in FIGS. 2, 3, the stainless steel strip is in the form of a ribbon having a helical configuration so as to provide continuous coils 26 extending throughout its length, thereby adding to the sponge-like characteristic of the pad P both increasing its porosity and adding to its abrasive effect on the finish of the floor treated with the pad P of the invention with the machine M.

A sufficient number of wraps 26 are applied to the disc 16 to build up a pad of sufficient thickness and thereby form a sponge-like mass of the stainless steel ribbon 24 with the core member or disc 16 disposed centrally within the mass and completely surrounded by the mass. The ribbon 24 is relatively thin, the thickness of the ribbon depending on the specific type of operations for which the pad P is to be used. The ribbon 24 is also relatively narrow, preferably within the range of 1/16 to ⅛ of an inch, the width depending to a degree on the type of operation for which the pad P is to be used.

In accordance with the effect desired on the surface to be treated utilizing the pad P, the coils 26 may be formed in a tight-fitting relationship or spaced-apart, forming either a curled or a semi-curled configuration respectively throughout the continuous length of the ribbon 24.

Another embodiment of the strip or ribbon which may be used to form the pad P is designated generally by the reference numeral 24' in FIG. 5. In FIG. 5 the ribbon 24' is a flat ribbon of stainless steel which may have a width and thickness selected in accordance with the considerations which dictate the dimensions of the ribbon 24 of FIG. 4. Thus, the ribbon 24 may be of the same dimensions as the ribbon 24' except that it is provided in a helical configuration to form coils 26 as explained above.

In another embodiment of the invention, the core member or disc 16 may be formed as a substantially flat planar member 27 of synthetic resinous material such as plastic or the like and the ribbon 24 or 24' wound thereon in the above-described manner.

In the use of the pad P of the invention, the pad P is attached to the floor machine M as shown in FIG. 1, and the operator proceeds to move the machine M along the surface to be treated with the pad P rotated in the usual manner by the motor 13. During the application of wax to the floor using the pad P, the coils 26 of the ribbon 24 produce a hard finish during a buffing operation on the floor and prevent tacking of the pad to the floor since the coils 26 continually cut excess material from the floor. The sponge-like effect imparted to the pad P by the curled ribbon 24 permits the pad to seat evenly under the floor machine M so that the machine M runs smoothly, eliminating operator fatique, and the pad does not carbon-burn or blacken the floor as is typical of prior art pads. After a single use of the pad P, it can be easily washed or steamed out and used repeatedly without rusting, and there is a total absence of any lint produced during the surface treating operation, since there is no fraying of the pad.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A pad adapted to be attached to a rotary buffing machine or the like for treating surfaces such as floors comprising, in combination, a substantially planar, disc-shaped rigid core member of stainless steel wire mesh having a top surface and a bottom surface and a marginal edge, a continuous narrow thin ribbon of stainless steel having a width between approximately 1/16 to ⅛ inches and of helical configuration to provide continuous coils extending throughout its length, said ribbon being wound successively and alternately over said core member top and bottom surfaces in random directions diametrically in a plurality of wraps extending around said marginal edge, portions of said wound ribbon being randomly distributed in overlying relationship to form a circular sponge-like mass with said core member disposed centrally within said mass.

* * * * *